US007430280B2

(12) United States Patent
Song

(10) Patent No.: US 7,430,280 B2
(45) Date of Patent: Sep. 30, 2008

(54) RADIATION EMITTING DEVICE

(76) Inventor: Shipeng Song, Room 605, No. 100, Qinzhou Road, Shanghai (CN) 200235

( * ) Notice: Subject to any disclaimer, the term of this patent is extended or adjusted under 35 U.S.C. 154(b) by 0 days.

(21) Appl. No.: 11/343,537

(22) Filed: Jan. 31, 2006

(65) Prior Publication Data

US 2007/0183578 A1 Aug. 9, 2007

(51) Int. Cl.

| | |
|---|---|
| ***G21K 1/04*** | (2006.01) |
| ***G21K 1/02*** | (2006.01) |
| ***G21K 1/00*** | (2006.01) |
| ***H01J 35/16*** | (2006.01) |
| ***G21F 5/02*** | (2006.01) |

(52) U.S. Cl. ..... 378/145; 378/147; 378/149; 378/203; 250/497.1; 250/498.1

(58) Field of Classification Search ..... 378/145–147, 378/149, 203, 210; 250/496.1, 497.1, 498.1
See application file for complete search history.

(56) References Cited

U.S. PATENT DOCUMENTS 2,999,590 A * 9/1961 Gerhardt ..... 209/564
4,342,914 A * 8/1982 Bjorkholm ..... 378/113
4,504,859 A * 3/1985 Grady et al. ..... 378/98.2
5,224,144 A * 6/1993 Annis ..... 378/146
5,491,738 A * 2/1996 Blake et al. ..... 378/71
5,528,653 A * 6/1996 Song et al. ..... 378/65
5,757,886 A * 5/1998 Song ..... 378/147

OTHER PUBLICATIONS

The following US Statutes: 37 CFR 1.84(p)(5), 37 CFR 1.121, and 37 CFR 1.125(b) & (c).(2008).*

* cited by examiner

*Primary Examiner*—Edward J Glick
*Assistant Examiner*—Anastasia Midkiff

(57) ABSTRACT

A radiation emitting source includes a radiation emitter, an emitter switch, a collimator, a rotating mechanism and a shielding enclosure. The collimator has a central axial through-hole portion and a plurality of radial apertures. The through-hole portion receives the radiation emitter therein. The radiation emitter is axially movable in the through-hole portion. The rotating mechanism is coupled to the collimator. The shielding enclosure has an opening and encloses the collimator therein.

4 Claims, 2 Drawing Sheets

RADIATION EMITTING DEVICE

BACKGROUND OF THE INVENTION

1. Field of the Invention

The present invention relates to radiation sources, and particularly to a radiation emitting device for use in a scanning imaging system.

2. Description of Prior Art

Almost most of conventional radiation sources used in scanning imaging systems are merely capable of generating fan-beam X-rays or cone-beam X-rays. Accordingly, the scanning imaging systems have to employ a line/array of detectors arranged for receiving/intercepting the fan-beam/cone-beam X-rays.

As such, a flying-spot X-ray radiation source is proposed and typically used in a X-ray inspection system for inspecting contents of objects, such as packages and containers used in the shipment of cargo among sea, land and air ports. However, the structure of most conventional flying-spot X-ray radiation source is unduly complex. In addition, the resolution of scanning images obtained by such conventional flying-spot X-ray radiation source is commonly unadjustable and therefore the scanning image is unclear.

SUMMARY OF THE INVENTION

Accordingly, an object of the present invention is to provide a radiation source device that is capable of overcoming the above-mentioned shortcoming associated with unadjustable resolution.

In order to achieve the above-mentioned object, a radiation source device is provided. The radiation source device includes a radiation emitter configured for emitting X-rays, an emitter switch, a rotating mechanism, and an annular shielding enclosure. The radiation emitter may be secured to the emitter switch, a disk-shaped collimator. The collimator has a central axial through-hole portion and a plurality of radial apertures configured for collimating the X-rays emitted from the radiation emitter into pencil beams. The through-hole portion receives the radiation emitter and the emitter switch therein. The rotating mechanism is coupled to the through-hole portion of the collimator for rotating the collimator. The annular shielding enclosure has an opening configured for allowing the pencil beams to exit therethrough. The shielding enclosure encloses the collimator, the radiation emitter and the emitter switch therein. The radiation emitter is jointly axially movable with the emitter switch in the through-hole portion between a first position where the radiation source device is in an off state and, the radiation emitter is misaligned with any one of the radial apertures, and thereby the X-rays emitted from the radiation emitter are blocked from exiting from the opening of the shielding enclosure, and a second position where the radiation source device is in an on state and, the radiation emitter is aligned with one of the radial apertures thereby the X-rays emitted form the radiation emitter are capable of exiting from the opening of the shielding enclosure.

Preferably, the radiation emitter is radially engaged with the collimator by means of one of splines and flat keys such that the radiation emitter, the emitter switch and the collimator are capable of collectively rotating relative to the shielding enclosure. However, in the on state of the radiation emitter, the radiation emitter and the emitter switch are generally at rest relative to the shielding enclosure. The radiation source may further includes a frame movable along a predetermined direction, the shielding enclosure being mounted on the frame.

The present radiation source may be employed in a flying-spot scanning imaging system, because the radiation emitter emits X-rays while the collimator rotates. Accordingly, the resolution of obtained scanning image may be adjusted by controlling the rotating/swinging speed of the collimator.

The above and other features of the invention, including various novel details of construction and combination of parts, will now be more particularly described with reference to the accompanying drawings, in which:

DETAILED DESCRIPTION OF PREFERRED EMBODIMENT

Figure 1:
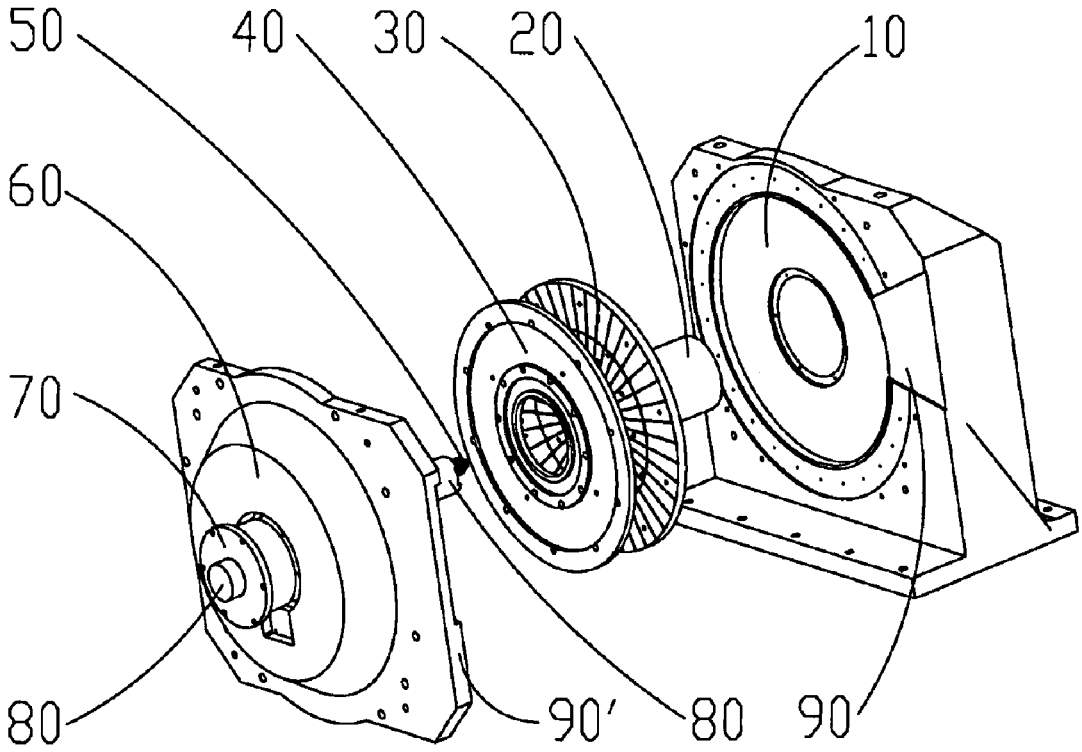
FIG. 1 is an, exploded view of a radiation source device in accordance with a preferred embodiment of the present invention.

Reference will now be made to the drawing to describe the present invention in detail.

Referring to FIG. 1, this illustrates a radiation source in accordance with a preferred embodiment of the present invention. The radiation source device includes a radiation emitter 50, an emitter switch 80, a collimator, a rotating mechanism and an annular shielding enclosure.

The radiation emitter 50 is an essentially cylindrical body. The radiation emitter 50 is provided for emitting X-rays (see FIG. 2). The radiation emitter 50 generally emits cone-beam X-rays 54. The emitter switch 80 is securely coupled to the radiation emitter 50. The collimator is substantially disk-shaped. The collimator includes a main body 30 and a cover 40 attached to the main body 30. The main body 30 has a central axial through-hole portion and a plurality of radial apertures. The main body 30 further includes a shaft 20 configured to be coupled to the rotating mechanism via a shaft adapter. The radial apertures are configured for collimating the X-rays emitted from the radiation emitter 50 into pencil beams. The radiation emitter 50 is axially movably received in the through-hole portion. The rotating mechanism is coupled to the through-hole portion of the collimator for rotating/swinging the collimator. The annular shielding enclosure has first part 10 having a first opening section 90 and second part having a second opening section 90'. The first opening section 90 and the second opening section 90' cooperatively define an opening configured for allowing the pencil beams to exit therethrough. The shielding enclosure encloses the collimator therein. The shielding enclosure has a through hole for receiving the through hole portion of the collimator, and a shielding stopper 70 attached to the through hole for shielding purposes.

Figure 2:
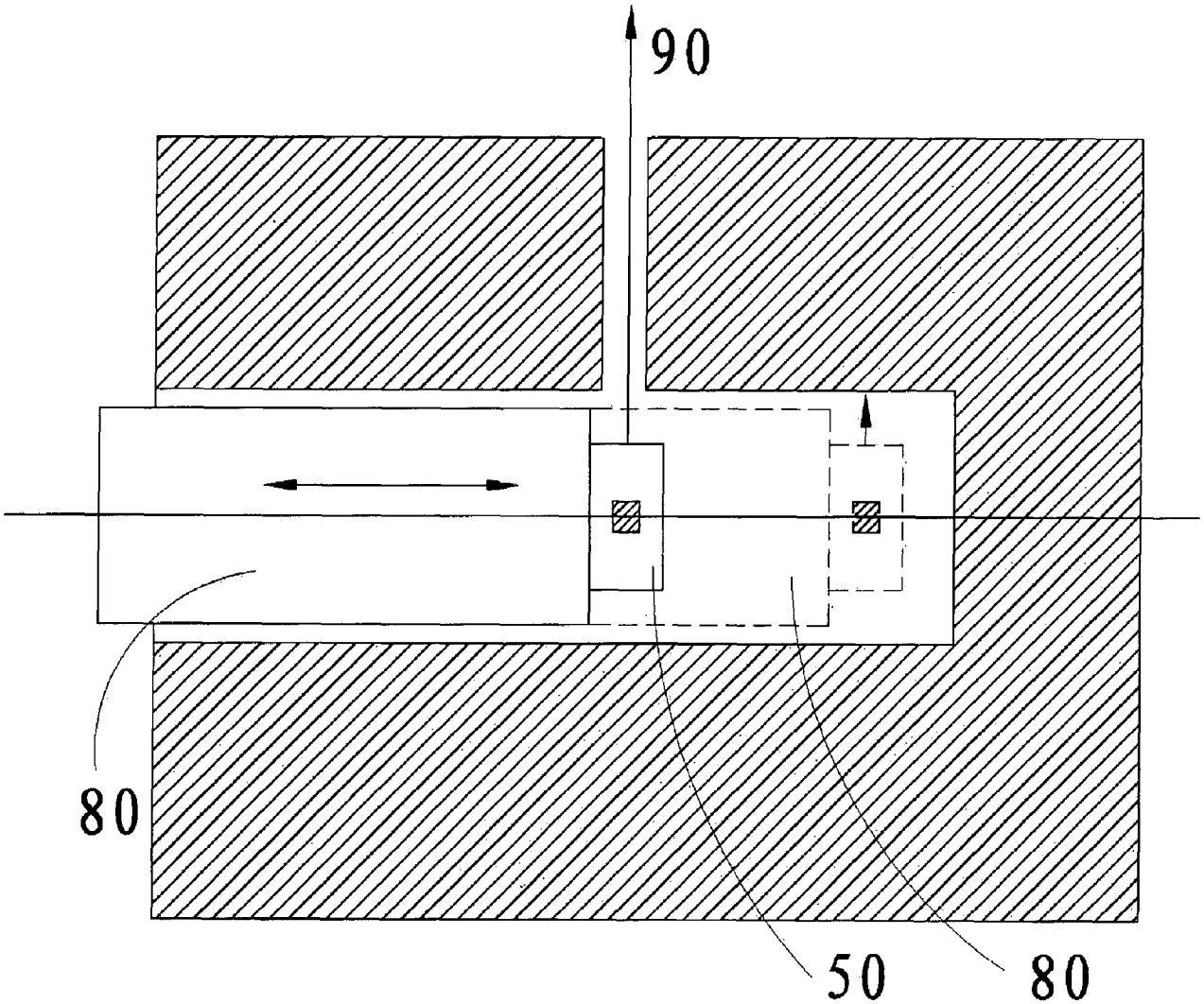
FIG. 2 is a schematic, cross-sectional view showing a radiation emitter and the emitter switch movable in the shielding enclosure according to the preferred embodiment.

Referring to FIG. 2, this is a schematic view showing the spatially relationship between the radiation emitter 50 and the shielding enclosure. The emitter switch 80 is configured for selectively switching the radiation emitter 50 between an off state and an on state. In other words, the radiation emitter 50 is jointly axially movable with the emitter switch 80 in the through-hole portion of the collimator between a first position (shown in solid lines) where the radiation source device is in an off state and, the radiation emitter 50 is misaligned with any one of the radial apertures of the collimator, and thereby the X-rays emitted from the radiation emitter 50 are blocked from exiting from the opening of the shielding enclosure, and a second position (shown in broken lines) where the radiation source device is in an on state and, the radiation emitter 50 is aligned with one of the radial apertures thereby the X-rays emitted form the radiation emitter 50 are capable of exiting from the opening of the shielding enclosure.

Preferably, the radiation emitter 50 is securely coupled to the emitter switch 80, and the radiation emitter 50 is radially engaged with the collimator by means of one of splines and flat keys such that the radiation emitter 50, the emitter switch 80 and the collimator are capable of collectively rotating relative to the shielding enclosure. However, in the on state of the radiation source device, the radiation emitter 50 and the emitter switch 80 are generally at rest relative to the shielding enclosure. The radiation source device may further include a frame movable along a predetermined direction, the shielding enclosure being mounted on the frame.

Although the present invention has been described with reference to a specific embodiment, it should be noted that the described embodiment is not necessarily exclusive and that various changes and modifications may be made to the described embodiment without departing from the scope of the invention as defined by the appended claims.

What is claimed is:

1. A radiation emitting device comprising:

a radiation emitter configured for emitting X-rays;

an emitter switch, the radiation emitter being secured to the emitter switch;

a disk-shaped collimator, the collimator having a central axial through-hole portion and a plurality of radial apertures configured for collimating the X-rays emitted from the radiation emitter into pencil beams, the through-hole portion receiving the radiation emitter and the emitter switch therein;

a rotating mechanism coupled to the through-hole portion of the collimator for rotating the collimator;

an annular shielding enclosure having an opening configured for allowing the pencil beams to exit therethrough, wherein the shielding enclosure encloses the collimator, the radiation emitter and the emitter switch therein; wherein the radiation emitter is jointly and axially movable with respect to the emitter switch in the through-hole portion between an off position and an on position, wherein in the off position, the radiation emitter is misaligned with any one of the radial apertures thus ensuring the X-rays emitted from the radiation emitter blocked by the shielding enclosure, and wherein in the on position, the radiation emitter is aligned with one of the radial apertures therefore ensuring the X-rays emitted from the radiation emitter exit from the opening of the shielding enclosure.

2. The radiation emitting device, as recited in claim 1, wherein the radiation emitter is radially engaged with the collimator such that the radiation emitter, the emitter switch and the collimator are collectively rotatable relative to the shielding enclosure.

3. The radiation emitting device as recited in claim 1, wherein in an on position, the radiation emitter and the emitter switch are at rest relative to the shielding enclosure.

4. The radiation source device as recited in claim 1, further comprising a frame movable along a predetermined direction, the shielding enclosure being mounted on the frame.

* * * * *